United States Patent [19]

Eisenburg

[11] 4,171,090

[45] Oct. 16, 1979

[54] TRACKWAY FOR A TRACKBORNE TOY

[76] Inventor: Rolf Eisenburg, No. 173, 5650 Wittkullerstrasse, Solingen-Wald, Fed. Rep. of Germany

[21] Appl. No.: 862,255

[22] Filed: Dec. 19, 1977

[30] Foreign Application Priority Data

Dec. 23, 1976 [DE] Fed. Rep. of Germany ..... 2658485

[51] Int. Cl.[2] ..... E01B 23/00; A63H 21/00

[52] U.S. Cl. ..... 238/10 R; 46/1 K; 46/43; 238/10 E

[58] Field of Search ..... 238/10 R, 10 E, 10 A; 46/1 K, 43, 216; 273/120 R, 118 R, 119 R

[56] References Cited

U.S. PATENT DOCUMENTS

| | | | |
|---|---|---|---|
| 1,252,616 | 1/1918 | Reif | 46/43 X |
| 1,679,911 | 8/1928 | Moffitt | 238/10 E |
| 3,132,441 | 5/1964 | Mahovosky | 46/43 |
| 3,496,669 | 2/1970 | Siggelkow | 46/43 X |
| 3,587,190 | 6/1971 | Ashton | 238/10 E X |
| 3,683,514 | 8/1972 | Hughes | 46/43 X |
| 3,703,989 | 11/1972 | Tomiyama | 238/10 E |
| 3,726,476 | 4/1973 | Porter et al. | 238/10 E |

*Primary Examiner*—Randolph A. Reese
*Attorney, Agent, or Firm*—John C. Smith, Jr.

[57] ABSTRACT

A trackway for a trackborne toy and variable in relationship to its course comprises two resiliently flexible carriers or track members stringently guided in bearings in a spaced juxtaposition. The bearings are supported on vertical supports height-adjustable as well as vertically and horizontally pivotable.

7 Claims, 7 Drawing Figures

FIG. 3
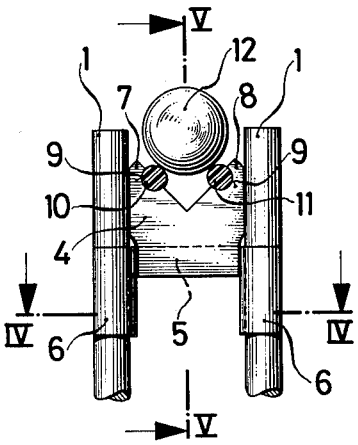
FIG.5
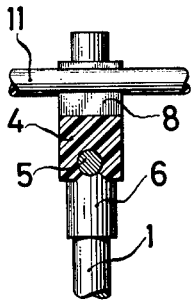
FIG.6
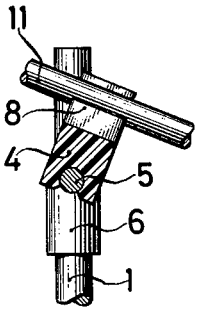
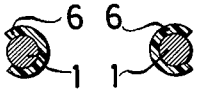
FIG. 4
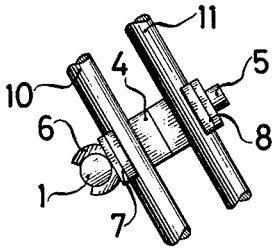
FIG. 7

TRACKWAY FOR A TRACKBORNE TOY

BACKGROUND OF THE INVENTION

This invention relates to a trackway provided for a trackborne toy, for instance a ball, said trackway being variable in relationship to its course.

A trackway provided for a rollable toy and variable in relationship to its course is already known. It comprises individual guide chutes which are retainable on a deformable carrier of a circular cross section and in which the toy rolls. The carrier is insertable into holes of a baseplate with its two angularly disposed ends, for retaining. The portion of the carrier disposed between the angularly arranged ends and remote from the baseplate defines a sort of bridge. As a result of the deformability of the carrier, the trackway may be deformed in such a way that it is composed of straights, upgrades, downgrades, loops or the like. In the conventional trackway, however, the carrier must have a certain rigidity, since it is supportable only with its two ends, so that the shape is maintained into which it is bent. Thereby, a form alteration deviating from straights, of the trackway, is relatively closely restricted. Furthermore, a plurality of guide chutes must be provided in order to be able to produce a trackway composed of straights, upgrades, downgrades and loops, which chutes must be connected to each other. Thereby, the assembly of the trackway is relatively complicated. Furthermore, in the conventional trackway, the lateral view of the moving ball is limited as a result of the fact that the ball runs in the guide chutes.

Furthermore, a track guide provided for motive toys driven by electric motors is also already known which track guide consists of a resiliently flexible carrier composed of two helically arranged electrical conductors insulated relative to one another. Such a track guide, however, is only usable for so-called suspension toys capable of being suspened at the carrier.

SUMMARY OF THE INVENTION

It is the object of the present invention to configurate a trackway provided for a trackborne toy, for instance a ball, and variable in relationship to its course in such a way that the range of trackway variations is substantially wider as compared with the conventional trackways, that the assembly of the trackway is relatively simple and that futhermore the view of the rolling toy is unobstructed.

To attain this object the present invention provides a trackway for a trackborne toy and variable in relationship to its course, wherein the trackway comprises two resiliently flexible carriers or track members stringently guided in bearings in a spaced juxtaposition and the bearings are supported on vertical supports height-adjustable as well as vertically and horizontally pivotable.

This twin-rail trackway for a trackborne toy is distinguished over the conventional trackways in that the course of the trackway as a result of the great flexibility of the two carriers and the stringent guiding of the carriers in the bearings is variable and practically unlimited. This in particular applies for the curve course of the trackway. Furthermore, with the trackway of this invention a view of the rolling toy is unobstructed, in contradistinction to a trackway in which the toy rolls in chutes.

An advantageous embodiment of the invention is one in which each bearing is adapted to accommodate both carriers and is provided with an arm on which it is pivotally mounted and with which it is supportable on at least one support. Thereby, in an advantageous way the number of structure parts of the trackway is kept to a minimum. Furthermore, a simple connection of the bearings with the supports is achieved.

In another advantageous embodiment of the invention each bearing is preferably provided with a bifurcation and the bifurcated ends having self-resiliency inwardly have a depression corresponding to the cross-sectional shape of the carriers for guiding the carriers. As a result of the self-resiliency of the bifurcated ends of the bearings, the carriers may be clamped into the depression of the bifurcated ends by finger pressure and thereby the carriers may be connected to the bearings in a simple way.

Preferably, the supports have associated therewith a baseplate which has a plurality of holes or receptacles into which the supports are insertable. The trackway may thereby be assembled in a simple way.

BRIEF DESCRIPTION OF THE DRAWINGS

Two embodiments of the invention will now be described by way of example and with reference to the accompanying drawings in which:

FIG. 3 is a side elevational view of a bearing guided on two partially illustrated supports with the two carriers or track members and a toy in the form of a ball disposed on the carriers;

FIG. 4 is a sectional view taken on the line IV—IV of FIG. 3;

FIG. 5 is a sectional view taken on the line V—V of FIG. 3;

FIG. 6 is a sectional view similar to FIG. 5, but with a bearing positioned in an inclined position, and FIG. 7 is a plan view of a bearing guided merely on one support.

DESCRIPTION OF THE PREFERRED EMBODIMENTS

Figure 1:
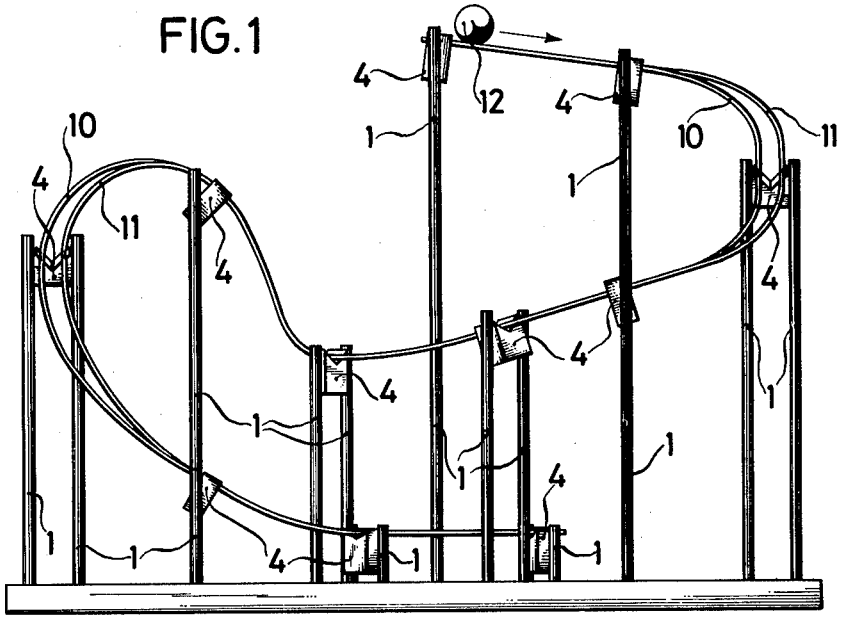
FIG. 1 is a schematic side elevational view of a trackway of a toy having generally the form of an eight.
Figure 2:
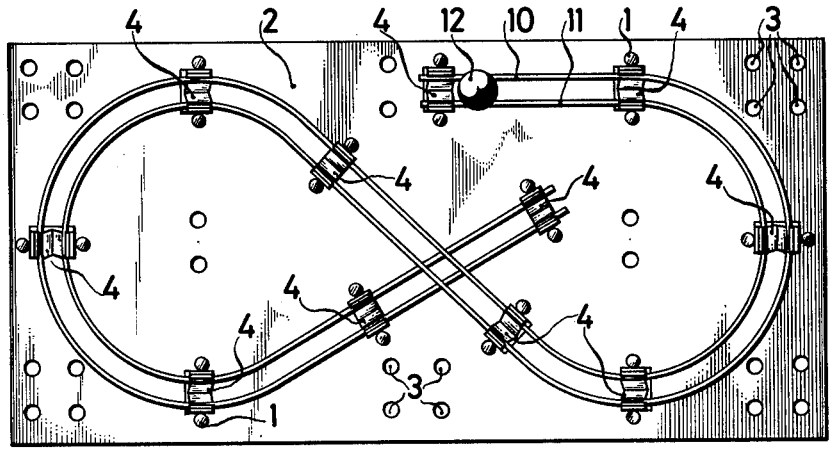
FIG. 2 is a plan view thereof.

1 designates a plurality of supports consisting of circular rods and having different lengths which are arranged vertically on a baseplate 2 and are loosely inserted into holes or receptacles 3 of the baseplate 2. The holes 3 are provided in such a number that the supports 1 may, if desired, i.e. for varying the course of the trackway, be rearranged. The reference numeral 4 designates bearings. Each bearing 4 is mounted pivotable on an elongate arm 5. In the event that the bearing next to its height adjustment is to be pivotable only in vertical direction, the arm 5 at both ends has a cylindrical arm 6 each with which it is guided so tightly on two opposing supports 1 that no additional securing of the bearing 4 in the respective position is required. The bearing 4 is bifurcated at its upper end. The bifurcated ends having self-resiliency and designated 7 and 8 inwardly each have a circular depression 9. The reference numerals 10 and 11 designate two resiliently flexible carriers or track members of a circular cross section which define the actual trackway for a ball-shaped toy 12. The carriers 10 and 11 are clamped into the depressions 9 in such a way that they are readily releasable therefrom for a disassembly of the trackway.

The bearing 4 illustrated in FIG. 7 is guided on one support 1 only, it thereby next to its height-adjustability and vertical pivotability also being horizontally pivotable.

In order to be able to place the outward carrier 10 at a higher level in a steep curve, the depression 9 at the one bifurcated end of a bearing 4 serving to support this carrier is at a higher level in relationship to the depression at the other bifurcated end.

The invention may be embodied in other specific forms without departing from the spirit or essential characteristics thereof. The embodiments are therefore to be considered in all respects as illustrative and not restrictive.

What is claimed is:

1. A trackway for a trackborne toy, the course of said trackway in both the horizontal and vertical planes being variable, said trackway comprising (a) a plurality of vertical support means adapted to be arranged along a predetermined path;

(b) a pair of spaced elongated flexible track members;

(c) a plurality of bearing members supporting said track members in spaced parallel relationship at spaced intervals along the length of said track members;

(d) first means pivotally supporting each of said bearing members for adjustment about a horizontal axis; and (e) second means supporting each of said first support means, said second support means including means adjustably engaging at least one of said vertical support means and adapted to permit positioning of said second support means at any selected position along the length of said vertical support means and to permit pivotal adjustment of said second support means along a vertical axis about said vertical support means;

(f) whereby each of said second support means may be independently raised or lowered on said vertical support means and pivoted about said vertical support means, and each of said bearing members may be pivoted to accommodate changes in the slope of said track member with respect to said vertical support means and in the course of said track members.

2. A trackway according to claim 1 wherein each of said bearing members is bifurcated, the bifurcated ends being resilient inwardly and including a pair of depressions corresponding to the cross-sectional shape of said track members for retaining said track members.

3. A trackway according to claim 1 further comprising a base plate having a plurality of receptacles therein for receiving said vertical support means, said receptacles being greater in number than the number of said vertical support means and being adapted to receive the ends of said vertical support means whereby the path along which said vertical support means are arranged may be varied, said second support means being adapted to accommodate corresponding variations in the course of said flexible track members.

4. A trackway according to claim 1 wherein each of said vertical support means comprises a pair of vertically disposed support members and said second support means comprises a pair of second support members, each adjustably engaging one of said pair of vertically disposed support members.

5. A trackway according to claim 4 wherein said pair of second support members are spaced from each other, and said first support means comprises a cylindrical arm extending between said pair of second support members, said bearing member including a recess for engaging said cylindrical arm and permitting pivotal movement thereabout.

6. A trackway according to claim 1 wherein each of said vertical support means comprises a vertically disposed support member and each of said second support means comprises a second support member adjustably engaging said vertically disposed support member.

7. A trackway according to claim 6 wherein a cylindrical arm extends from each of said second support members, each of said bearing members including a recess for engaging said cylindrical arm and permitting pivotal movement thereabout.

* * * * *